US005445288A

United States Patent [19]

Banks

[11] Patent Number: 5,445,288

[45] Date of Patent: Aug. 29, 1995

[54] LIQUID DISPENSER FOR DISPENSING FOAM

[75] Inventor: Stewart Banks, Brantford, Canada

[73] Assignee: Sprintvest Corporation NV, Curacao, Netherlands Antilles

[21] Appl. No.: 223,148

[22] Filed: Apr. 5, 1994

[51] Int. Cl.[6] ..... B65D 35/28

[52] U.S. Cl. ..... 222/95; 222/105; 222/190; 222/325; 222/340; 222/383; 222/181.2; 222/189.06; 222/321.7; 222/383.3; 239/343; 239/371

[58] Field of Search ..... 222/95, 96, 105, 145, 222/181, 185, 189, 190, 321, 325, 340, 383, 450; 239/321, 343, 371

[56] References Cited

U.S. PATENT DOCUMENTS

| | | | |
|---|---|---|---|
| 3,422,993 | 1/1969 | Boehm et al. | 222/190 |
| 3,709,437 | 1/1973 | Wright | 239/343 |
| 3,743,146 | 7/1973 | Schindler | 222/450 X |
| 3,985,271 | 10/1976 | Gardner | 222/190 |
| 4,019,657 | 5/1977 | Spitzer et al. | 222/136 |
| 4,022,351 | 5/1977 | Wright | 239/343 X |
| 4,621,749 | 11/1986 | Kanfer | 222/383 X |
| 4,978,036 | 12/1990 | Burd | 222/181 X |
| 5,048,750 | 9/1991 | Tobler | 222/189 |
| 5,156,307 | 10/1992 | Callahan et al. | 222/189 |
| 5,165,577 | 11/1992 | Ophardt | 222/181 |
| 5,174,476 | 12/1992 | Steiner et al. | 222/189 X |
| 5,248,066 | 9/1993 | Olson et al. | 222/105 |

*Primary Examiner*—Andres Kashnikow
*Assistant Examiner*—Joseph A. Kaufman
*Attorney, Agent, or Firm*—Hill & Schumacher

[57] ABSTRACT

There is disclosed a foaming device for dispensing foam. The device includes a collapsible liquid container and a foam pump attached to the container outlet. The foam pump includes two enclosures, the first being bonded in the throat of the container and the second being telescopingly received in the first. When assembled, the two enclosures define an air chamber and a fluid chamber each having outlets which merge by the foamer outlet. The fluid chamber accepts liquid from the container and when the second member is moved with respect to the first member the fluid chamber is pressurized to open an outlet valve and air is simultaneously expelled through the outlet. The liquid and air commingle as they pass through a wire, plastic or fabric mesh thereby forming the foam. There is included a dispenser housing for releasibly receiving the collapsible liquid container and foam pump. The dispenser includes a push button pivotally attached thereto which is coupled to the second enclosure so that as the push button is moved the pump is actuated.

18 Claims, 7 Drawing Sheets

LIQUID DISPENSER FOR DISPENSING FOAM

FIELD OF THE INVENTION

The present invention relates to dispensers for liquids, and more particularly to dispensers which dispense the liquid as a foam.

BACKGROUND OF THE INVENTION

Liquid dispensers for dispensing soaps and the like are well known. A large number of dispensers for dispensing for example hand cleaning soaps dispense the liquid itself. In many applications it is preferable to dispense the soap in the form of a foam. Foams tend to be much easier to spread than the corresponding liquid and in addition there is much less waste due to splashing or run-off since the foam has a much higher surface tension than the liquid. A foam requires much less liquid to produce the same cleaning power as obtained with the un-foamed liquid due to the much higher surface area of the former.

Known prior art foaming devices are generally of two types. In the first type of roamer, such as disclosed in U.S. Pat. Nos. 4,019,657 and 3,709,437 the foam is produced by a jet of air. A disadvantage of this first type of roamer is that the quality of the foam varies as the dispensing force is varied.

The second type of foam dispenser, as disclosed in U.S. Pat. Nos. 3,422,993 and 3,985,271 uses a porous material through which the foamable liquid is pumped thereby mixing the liquid with air to form the foam. Drawbacks to this type of foamer is that a considerable amount of pressure is required to force the liquid through the porous material. A further drawback to both types of foam dispensers is that the foamer is located at the top of the dispenser and a tube extends down to the bottom of the liquid storage container so that considerable force must be applied to pump the liquid up into the foamer and to dispense it therefrom.

In many of the prior art foaming devices the foamer unit is separate from the container holding the liquid. When the liquid container is replaced the operator generally has to interconnect the foamer unit with the liquid container which can be an inconvenience. It would therefore be advantageous to provide a foam dispenser which allows convenient and rapid replacement of the liquid container in the dispenser.

Liquid detergents or soaps for hand cleaning generally require preservatives to increase shelf life of the detergent. Antioxidants are typically present as a additive to reduce oxidation of the soap in the presence of air normally present in the soap container and this adds to the cost of the soap. In the presence of air many soaps tend to thicken which requires increasing force to dispense the liquid. The thickened liquid is prone to clogging up the dispensing pathway.

Accordingly, it would be advantageous to provide a dispenser which produces and dispenses a liquid in the form of foam and in which the liquid is not exposed to air until expelled from the liquid container portion of the dispenser.

SUMMARY OF THE INVENTION

The present invention provides a device for producing and dispensing foam. The device includes a container for storing a liquid in the interior thereof. Included is a pump means which is attachable to the container. The pump means includes an air chamber having an air inlet and an air outlet. The pump means includes a fluid chamber provided with a fluid outlet positioned with respect to the air outlet so that liquid exiting the fluid outlet communicates with the air outlet. The fluid chamber has a liquid inlet in flow communication with the container interior and further includes a liquid inlet valve. The liquid inlet valve is movable between an open position to allow liquid from the container to enter the fluid chamber and a closed position. The pump means includes a liquid outlet valve located in the fluid chamber spaced from the liquid inlet valve. The liquid outlet valve is biased in the closed position. The pump means includes a porous member for generating turbulence in fluid passing therethrough and is positioned to receive air and fluid from the air and fluid chamber outlets. The pump means includes means for pressurizing the air chamber and the fluid chamber whereby when the fluid chamber is sufficiently pressurized the liquid inlet valve closes and the liquid outlet valve opens thereby forcing liquid through the fluid chamber outlet to commingle with air being simultaneously expelled through the air chamber outlet. The resulting liquid-air mixture is forced through the porous member.

In another aspect of the invention there is provided a dispenser for producing and dispensing foam. The dispenser includes a container for storing a liquid in the interior thereof. The dispenser includes pump means attachable to the container. The pump means includes an air chamber having an air inlet and air outlet. The pump means includes a fluid chamber provided with a fluid outlet positioned with respect to the air outlet so that liquid exiting the fluid outlet communicates with the air outlet. The fluid chamber has a liquid inlet in flow communication with the container interior and includes a liquid inlet valve, the liquid inlet valve being movable between an open position to allow liquid from the container to enter the fluid chamber and a closed position. The pump means includes a liquid outlet valve located in the fluid chamber spaced from the liquid inlet valve. The liquid outlet valve is biased in the closed position. The pump means includes a porous member for generating turbulence in fluid passing therethrough and the porous member is positioned to receive air and fluid from the air and fluid chamber outlets. The pump means includes means for pressurizing the air chamber and the fluid chamber whereby when the fluid chamber is sufficiently pressurized the liquid inlet valve closes and the liquid outlet valve opens thereby forcing liquid through the fluid chamber outlet to commingle with air being simultaneously expelled through the air chamber outlet. The resulting liquid-air mixture is forced through said porous member. The dispenser includes a housing, the container with attached pump means being releasably insertable into the housing. The housing includes a lever attached to the housing and movable with respect thereto. The pump means is operably coupled to the lever so that moving the lever pressurizes the air and fluid chambers simultaneously.

BRIEF DESCRIPTION OF THE DRAWINGS

The following is a description, by way of example only, of the liquid dispenser for dispensing foam forming the present invention, reference being had to the accompanying drawings, in which.

DETAILED DESCRIPTION OF THE INVENTION

Figure 1:
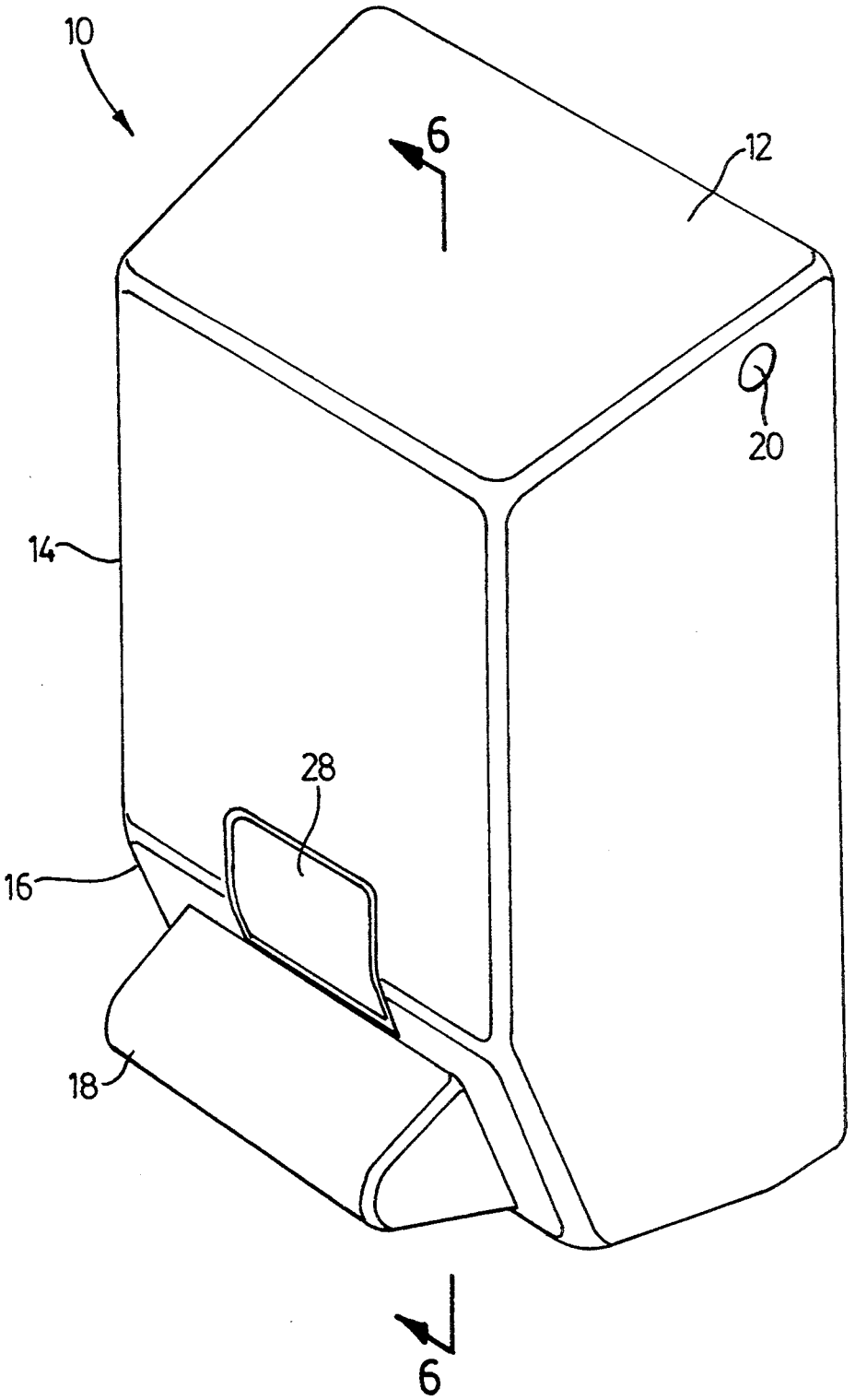
FIG. 1 is a perspective view of a dispenser housing constructed in accordance with the present invention.

Referring first to FIG. 1, a liquid dispenser containing a dispenser constructed in accordance with the present invention is shown generally at 10. Dispenser 10 includes a housing 12 enclosing an upper liquid dispenser compartment 14 and a lower compartment 16 housing a foam producing pump to be discussed below. A hand actuated lever or pushbutton 18 is pivotally attached to lower compartment 16. An aperture 20 is located in the side of housing 12 for allowing access to a locking mechanism which locks the generally rectangular housing to a back plate (not shown) which is secured to a support surface such as a wall. A view port 28 is provided on the front of housing 12 for viewing the liquid level in the liquid container.

Figure 2:
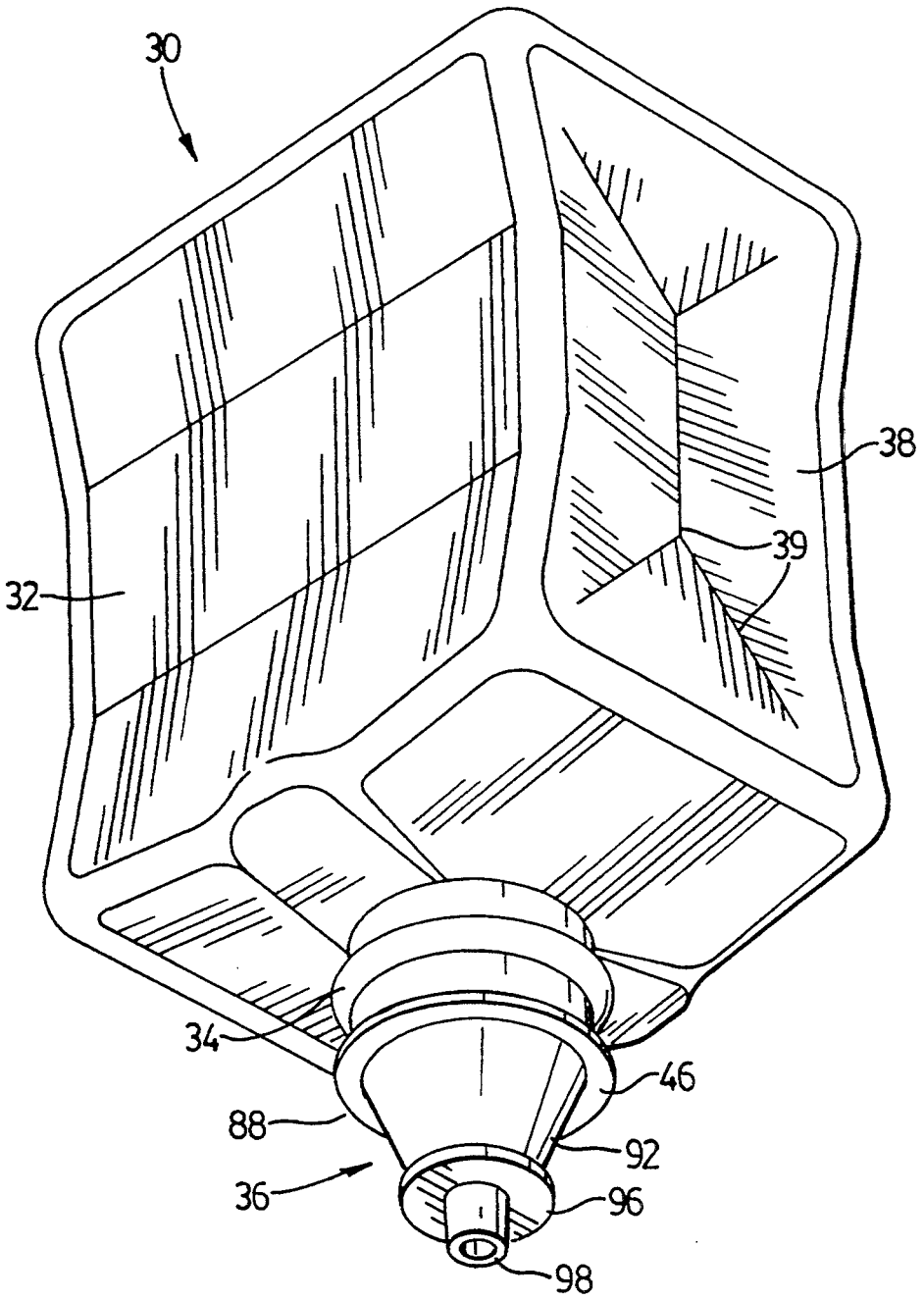
FIG. 2 is a perspective view of a liquid container and foam pump attached thereto.

Dispenser 10 is designed to releasibly receive therein a liquid container shown generally at 30 in FIG. 2 comprising a liquid storage compartment 32 and a liquid outlet 34. Attached to the liquid outlet 34 of container 30 is a foam pump shown at 36. Container 30 is a flexible plastic container for holding liquids such as soap and the like and is collapsible. Container 30 is gusseted along the sides 38 thereof so that as liquid is drained the container collapses along creases 39 to form an I beam section. A view port 28 is provided on the front of housing 12, best seen in FIG. 1, for viewing the liquid level in liquid container 30 when the latter is assembled with the housing.

Figure 3:
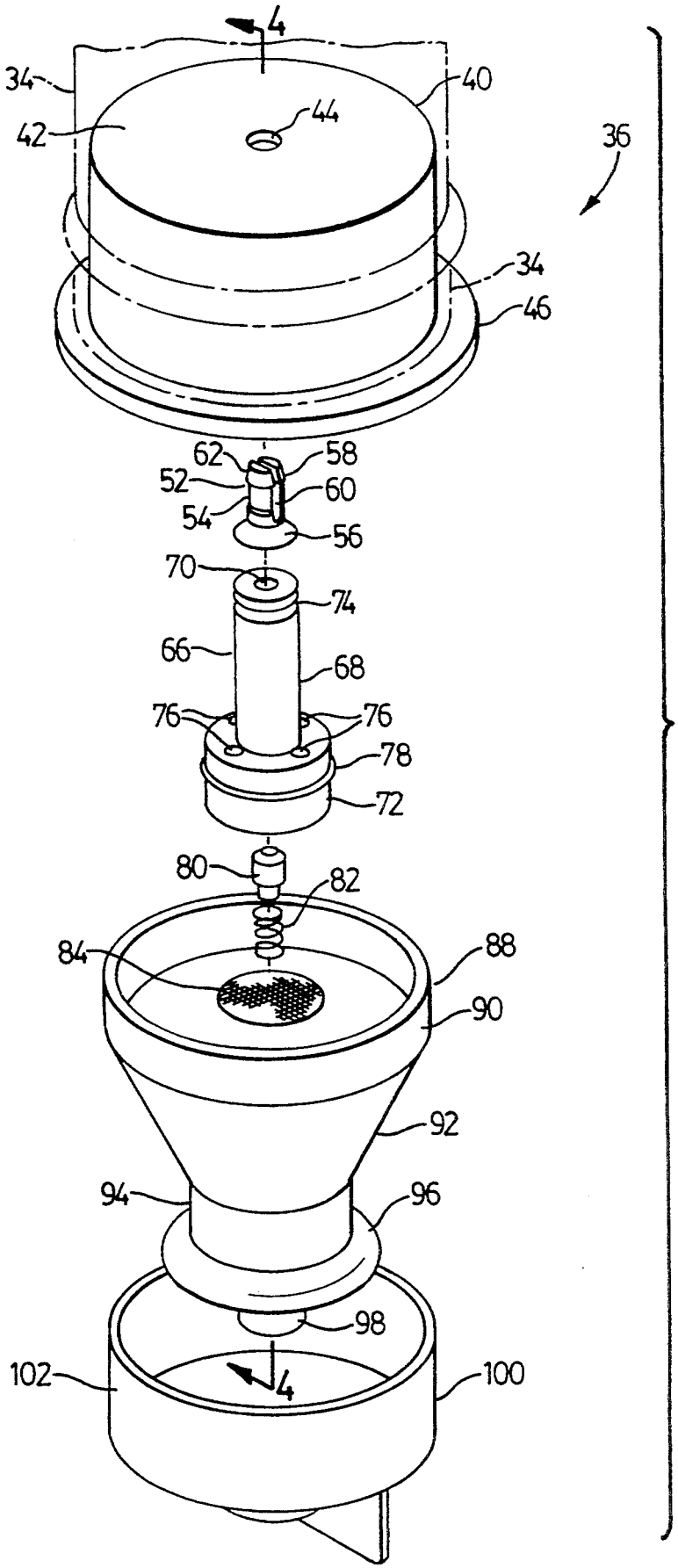
FIG. 3 is an exploded perspective view of the foam pump of FIG. 2.
Figure 4:
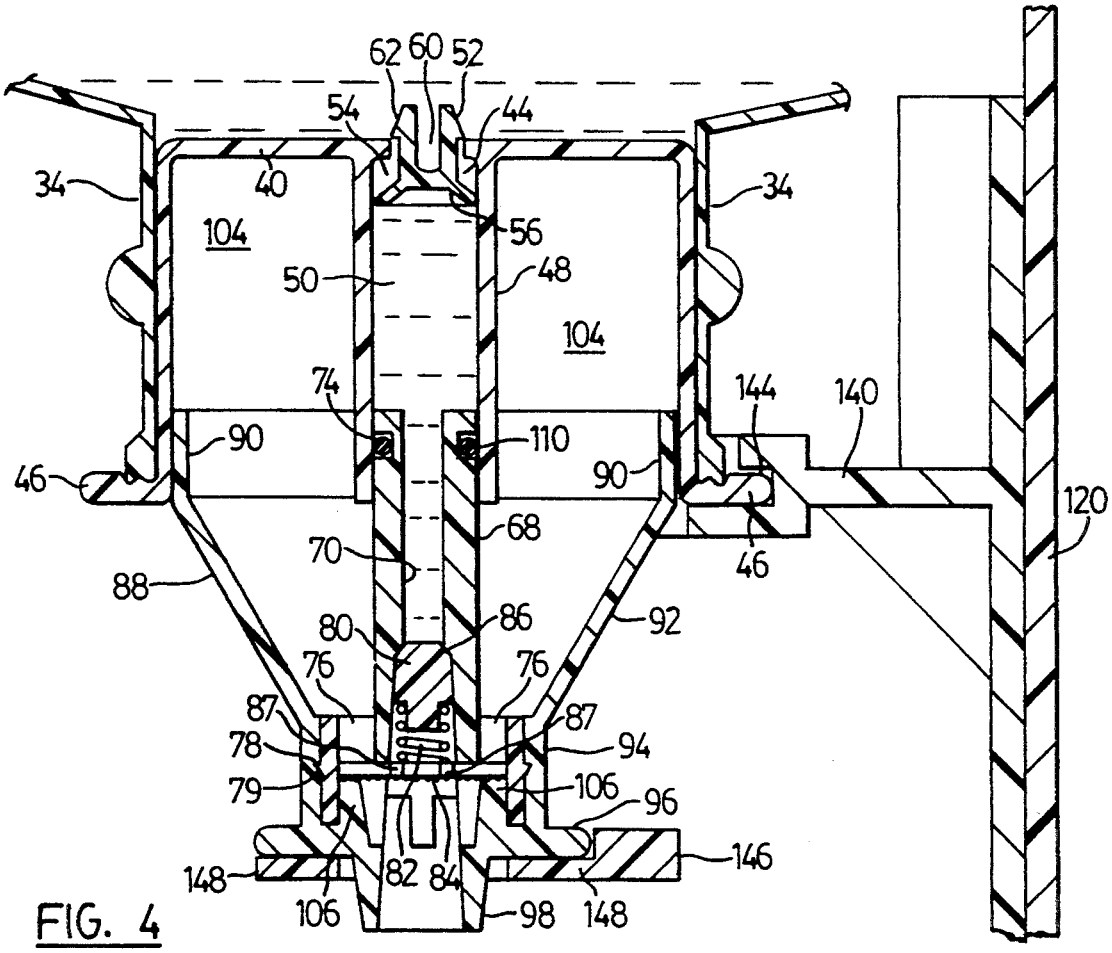
FIG. 4 is a cross sectional view taken along the line 4—4 of FIG. 3 when the foam pump is assembled and with the pump in the unactuated position.
Figure 5:
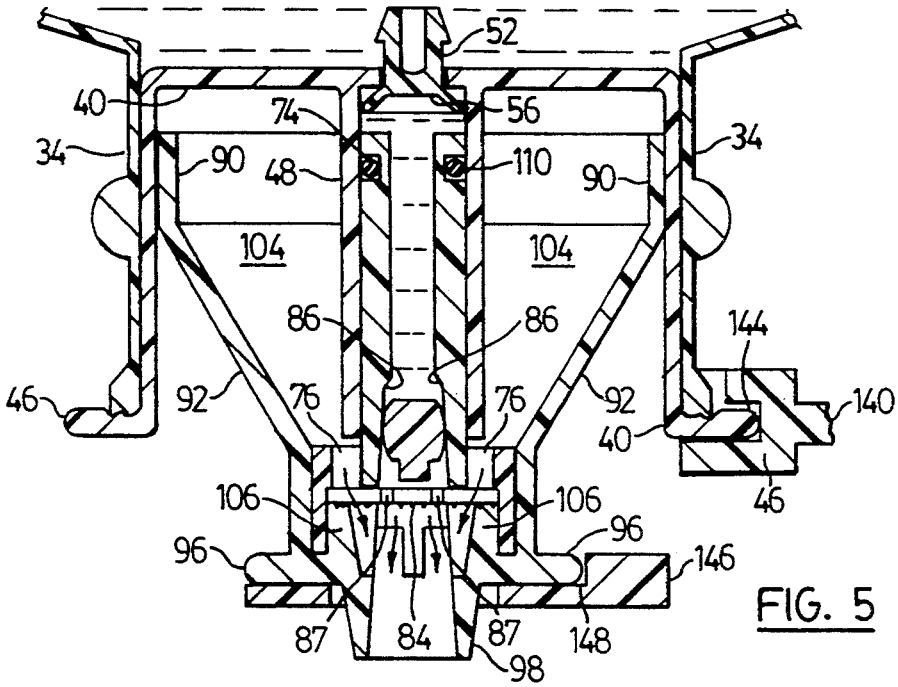
FIG. 5 is a view similar to FIG. 4 but showing the pump in the actuated position for expelling foam from the dispenser.

The exploded view of FIG. 3 illustrates the components from which foam pump 36 is constructed and FIGS. 4 and 5 illustrate the assembled foamer in the two extreme positions. Foam pump 36 includes a cup-shaped enclosure member 40 having a top portion 42 with an aperture 44 centrally located therein. Enclosure 40 includes a shoulder 46 against which the edge of throat 34 of container 30 (shown in ghost outline) abuts when pump 36 is assembled with container 30. Aperture 44 forms a fluid inlet for liquid entering pump 36 from compartment 32 to be discussed later. A conduit 48 (visible only in FIGS. 4 and 5) is attached to the top portion 42 on the interior of enclosure member 40 and encloses a passageway 50.

Foam pump 36 is provided with an inlet valve 52 comprising a valve stem 54 and a valve head 56. Stem 54 is in the shape of a tuning fork with two spaced arms 58 depending from head 56 and defining a slot 60 therebetween. The end portions of arms 58 spaced from valve head 56 are provided with shoulders 62. When assembled as seen in FIGS. 4 and 5, inlet valve 52 is located in aperture 44 and retained therein by shoulders 62 and valve head 56 extending laterally beyond the edge of the aperture.

Foam pump 36 includes a piston 66 provided with a shaft 68 having a passageway 70 extending therethrough. Shaft 68 is attached to a piston head 72 at one end thereof and is provided with an 0-ring groove 74 adjacent the other end thereof. Passageway 70 extends through piston head 72. Air vent inlet and outlet holes 76 are shown disposed about piston head 72 which extend through the head. Extending circumferentially around piston head 72 is a rib 78.

Pump 36 includes an outlet valve 80, an associated spring 82 and a wire gauze, grid or mesh 84. Mesh 84 may be fabricated of plastic, wire or cloth material. Mesh 84 produces turbulence in the air-liquid mixture to aid in foam production. The portion of passageway 70 located in piston head 72 is tapered and of larger diameter than the portion extending through shaft 68 to act as a valve seat 86 for valve 80.

Pump 36 further includes a conically shaped hollow member 88 having an upper cylindrical section 90, a conical section 92, a lower cylindrical section 94 provided with a circumferential rib 96 and an passageway 98. A protective cap or dust cover 100 having a cylindrical section 102 is provided as a cover for passageway 98.

Referring to FIG. 4, a web 106 is located on the interior of conical member 88 in the lower cylindrical section 94 and extends inwardly to act as a support for grid 84. Thus, when pump 36 is assembled as seen in FIGS. 4 and 5, grid 84 is supported on web 106 and piston 66 is pressed down into cylindrical section 94 and positioned and locked in place by rib 78 snapping into internal circumferential groove 79. Spring 76 bears against mesh 84 but is supported by web 106 and the spring and outlet valve 80 are located in passageway 70 with the valve bearing against valve seat 86 in the closed position. Piston head 72 is provided with a fluid chamber out such as a channel 87 directed at right angles to channel 70 which is adjacent to and intersects air outlets 76.

Conically-shaped member 88 is received within cup-shaped member 40 whereby the diameter of cylindrical section 90 is chosen to ensure a friction fit but which allows member 88 to be moved in and out with respect to section 40. Shaft 68 is received within conduit 48 and an 0-ring 110 seated in O-ring groove 74 provides a seal between the outer surface of shaft 68 and the inner wall of conduit 48. Protective cap 100 (FIG. 3) is inserted into cup-shaped member 40 where cylindrical section 102 is the same diameter as section 90 so that it is received within cup-shaped member 40 and retained therein by a friction fit.

The outer diameter of cup-shaped member 40 and the inner diameter of throat 34 of liquid container 30 are chosen so member 40 can be inserted into the throat with a snug fit with the throat edge bearing against shoulder 46, FIG. 4. Cup-shaped member 40 is then welded to container 30 to permanently attach it thereto. Conically-shaped member 88 and cup-shaped member 40 when assembled define an air chamber 104 separate from both fluid chamber 50 and the interior of liquid storage compartment 32 of container 30. In this way the air used to mix with the liquid to form the foam is imported from the exterior of the container. The inner diameter of cup-shaped member 40 and the outer diameter of cylindrical section 90 are chosen to produce a substantially air-tight connection so that air chamber 104 can be pressurized by pushing member 88 inwardly into member 40.

Figure 6:
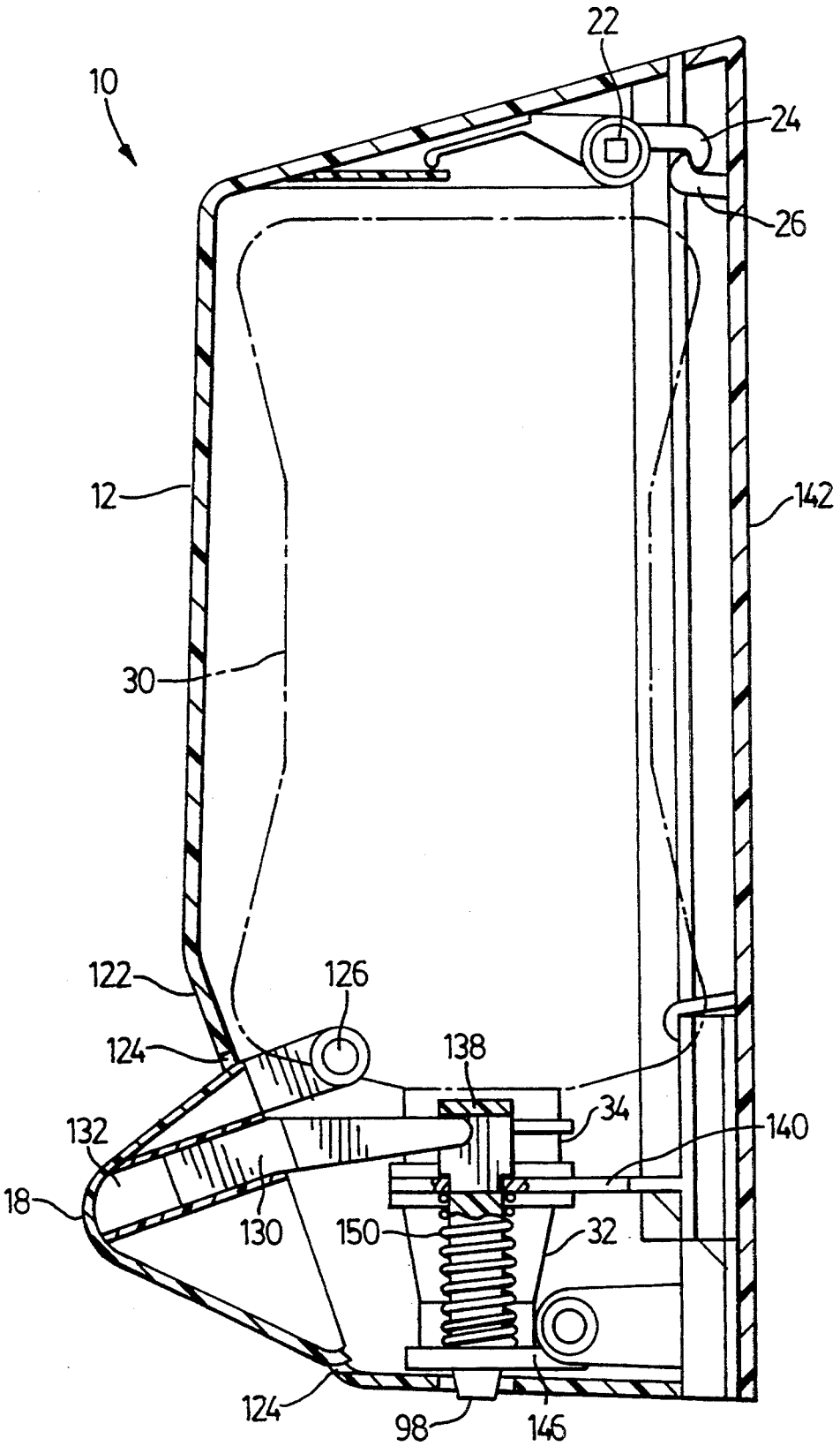
FIG. 6 is a sectional view along the line 6—6 of FIG. 1.
Figure 7:
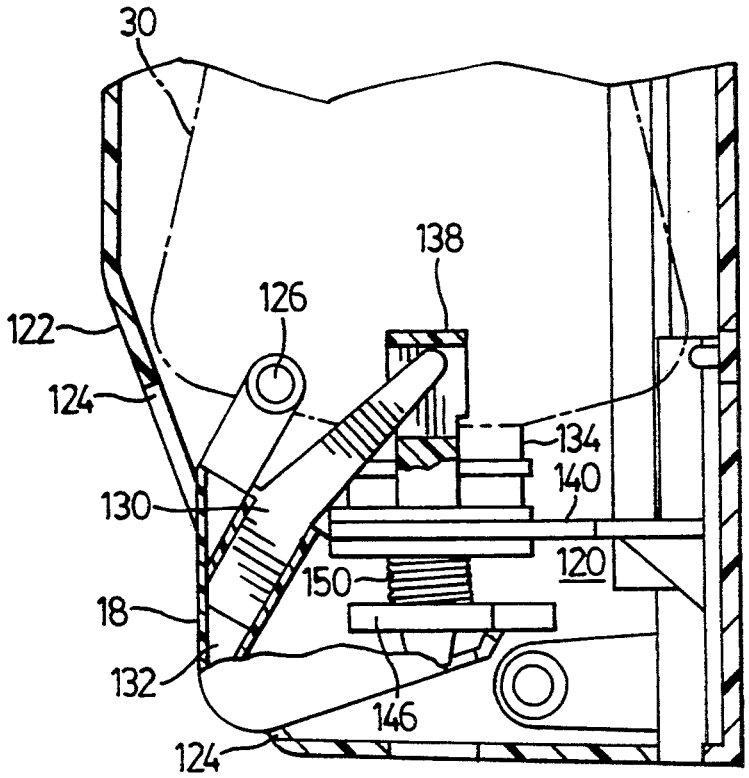
FIG. 7 is a sectional view similar to FIG. 6, but broken away and showing the pump in the depressed position.
Figure 8:
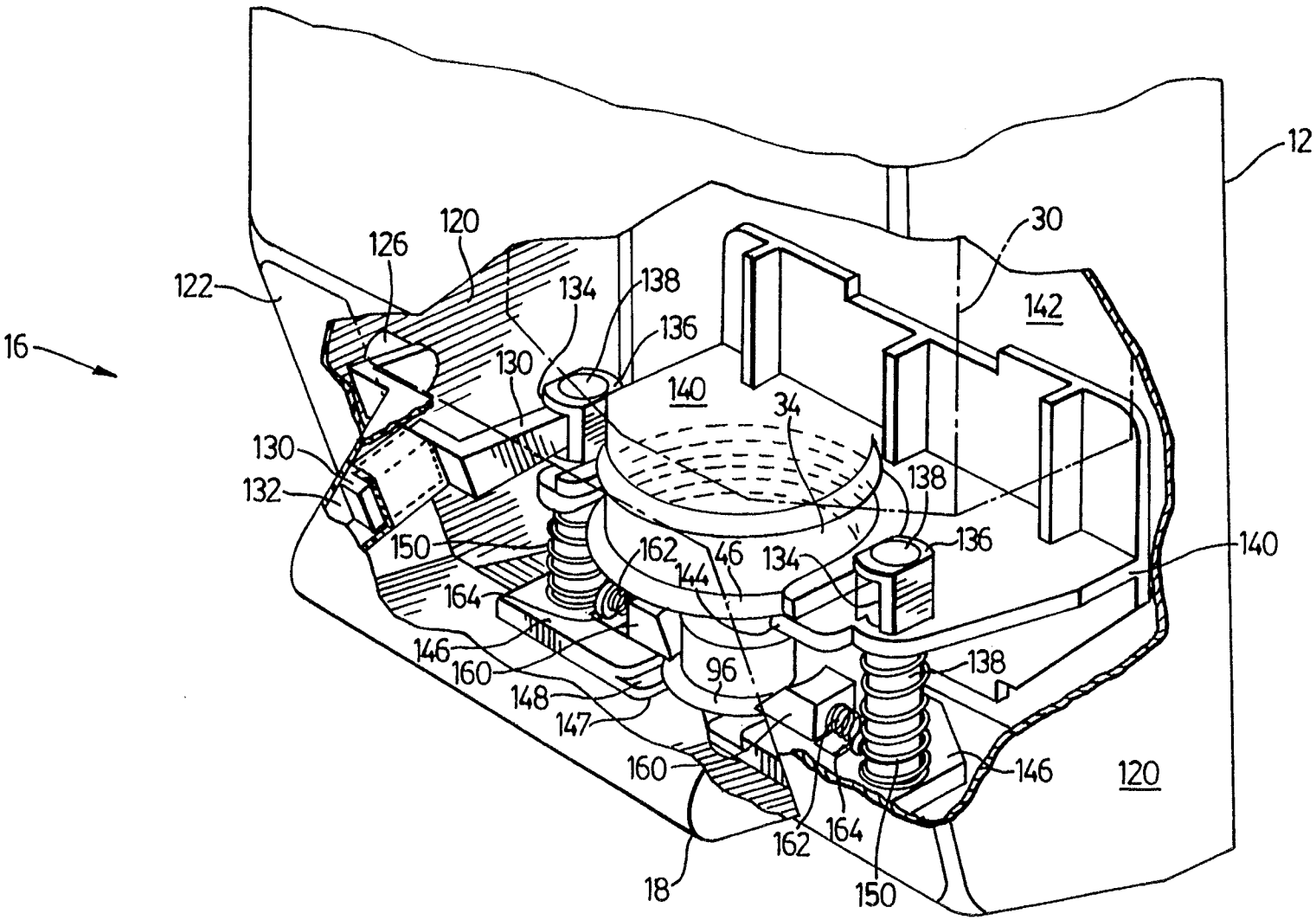
FIG. 8 is a perspective view, broken away, of a portion of the dispenser housing containing the foam pump.

The combination of assembled container 30 and foam pump 36 may be used alone in a manner to be described below or alternatively may be used in conjunction with dispenser housing 12. FIG. 6 illustrates a cross sectional view of housing 12 incorporating assembled container 30 and pump 36. With reference to FIGS. 6 to 8, lower compartment 16 of housing 12 is defined by side walls 120 and a front wall 122 having a generally rectangular aperture 124 located therein. Pushbutton 18 is pivotally connected to side walls 120 at position 126 and may be rotated about this pivotal connection. The ambit of this rotational movement is best seen by comparing the pushbutton positions in FIGS. 6 and 7 so that in the former, pushbutton 18 is fully extended and in FIG. 7 it is fully depressed.

A pair of arms 130 are slidably movable in channels 132 formed in the interior of pushbutton 18 at the edges thereof. The other ends of arms 130 are received into slots 134 located in sleeves 136 which fit over the upper end of posts 138. Posts 138 pass through holes located in a yoke-shaped support bracket 140 rigidly attached to back wall 142 of the housing. Extending about the inner edge of the circular cut-out in bracket 140 is a slot 144. The other end of posts 138 opposed to the ends containing sleeves 136 are rigidly attached to a yoke shaped platform 146 containing a central cut-out 147 and an inwardly protruding shoulder 148. Each post 138 is provided with a spring 150 between bracket 140 and platform 146 to bias the platform down away from platform 140.

When pushbutton 18 is pushed in it pivots down about pivot point 126 thereby rotating arms 130 so that the ends of the arms in sleeves 136 move upwardly to pull posts 138 and platform 146 upwardly against springs 150. Releasing pushbutton 18 results in platform 146 being returned to the lowered position by the action of springs 150. As pushbutton 18 is moved, arms 130 slide in channels 132, compare FIGS. 6 and 7.

Platform 144 is provided with a pair of opposed bosses 160 each spring biased inwardly over shoulders 148 by springs 162. Bosses 160 travel in slots 164.

To insert assembled container 30 and pump 36 into housing 12, a key (not shown) is inserted into aperture 20 (FIG. 2) to engage a locking mechanism 22 (FIG. 6) and when unlocked, hook 24 is disengaged from catch 26 and the front portion of the housing is pivoted downwardly away from back wall 120. Referring to FIG. 8, container 30 and foam pump 36 are then inserted into housing 12 with conical member 88 pushed up into section 40 and rib 46 is received by slot 144. Pushbutton 18 is then pushed inwards so that platform 146 is raised and when the convex inner surfaces of bosses 160 are engaged by rib 96 thereby pushing them outwardly against springs 162. When platform 146 has been raised high enough, bosses 160 snap over the top edge of rib 96 thereby locking conical member 88 with platform 146. When container 30 and foam pump 36 is assembled with dispenser housing 12 and pushbutton 18 is moved as described above, conically-shaped member 88 moves in and out of cup-shaped member 40 to create a pumping action.

In operation, to dispense foam from liquid from container 30 a user places the hand to receive foam under housing 12 adjacent to outlet 98 and with the other hand depresses pushbutton 18, see FIG. 6. Referring now to FIG. 4, with conical member 88 in the lowered position, inlet valve 52 is in the open position so that liquid flows into chamber 50 through slot 60 and aperture 44 in the direction of the arrows. Liquid fills chamber 50 and passageway 70 in piston 68. Outlet valve 80 is in the closed position being urged onto valve seat 86. When the user depresses pushbutton 18 conical member 88 is pushed up into cup-shaped member 40 thereby pressurizing air chamber 104 and the fluid chamber comprising chamber 50 and passageway 70. Upon pressurizing the fluid chamber, inlet valve 52 is pushed upwardly thereby closing off fluid inlet 44. Outlet valve 80 is forced open when the fluid chamber has been pressurized a predetermined amount as determined by the force of spring 82 to thereby supply fluid to the fluid chamber outlet 87.

Air chamber 104 is being simultaneously pressurized as the volume is decreased so that air is forced (in the direction of the arrows shown) through holes 76 in piston head 72. Referring to FIG. 5, once outlet valve 80 is opened, liquid is forced around the valve and is directed by outlet channel 87 to make a right angle turn and is directed into the air stream being forced out of air chamber 104. The air and liquid commingle and the mixture is forced through mesh 84 to produce foam. The foam is expelled through passageway 98 to the user's hand. The properties of the foam, ratio of liquid to air may be controlled by the mesh or grid 84 and the relative volumes of the air chambers and fluid chambers. A foam with an air to liquid ratio of 20:1 has been found to be quite useful when liquid hand soap is being dispensed.

When conically-shaped member 88 is urged back away from member 40 by springs 150, air is sucked back into air chamber 104 by being drawn back through outlet 98 and through air vents 76 and into the air chamber. Residual foam remaining in mesh 84 or outlet passageway 98 is then sucked back into air chamber 104 so that the foam pump is self cleaning. As member 88 is being urged back out of member 40, inlet valve 52 is pulled downwardly thereby opening inlet 44 and liquid is drawn into chamber 50 from container 30. Depressing pushbutton 18 repeats the foam production step described above.

Foam pump 36 is advantageous over prior art foamers because the same amount of pressure is required to operate the pump and produce the foam regardless of the amount of liquid in the container. Further, less work in general needs to be exerted since the liquid is not being forced up a tube or being forced through a thick porous plug. Also, the shape of the container is not restricted in shape by the need to hand squeeze it as with many of the prior art foamers. Another advantage of the foamer of the present invention is that the liquid is maintained in a relatively air-tight dispenser with no mixing with air until expelled from the fluid chamber. In this way long term oxidation of the ingredients making up the liquid is reduced. Every time a container is replaced, a new foam pump is provided with the container. This is advantageous since it avoids extended usage of the same pump so that problems such as blockage of passageways is avoided.

A further advantage of the foaming device disclosed herein is that thick, rigid porous plugs are avoided for generating foam as found in many of the prior art devices. The thin mesh or grid 84 as illustrated is sufficient to generate foam of appropriate quality.

It will be appreciated that container 30 and foam pump 36, being fabricated of plastic, except for spring 82 (and possibly grid 84), may be readily recycled after the contents of container 30 have been consumed.

The combination of filled collapsible container 30 and foam pump 36 attached thereto (FIG. 2) is preferably sold as a single unit (with cap 100) as a replacement charge for use with dispenser housing 12 in applications requiring fixed locations for the dispenser such as rest rooms, other sanitary stations and the like. Alternatively, it will be appreciated that the combination of container 30 and foam pump 36 may be used in applications where the user carries the unit about and hand pumps foam from the device. This is advantageous in for example hospitals where patients must be washed in bed. In such applications container 30 is held in one hand and conically-shaped member 88 is pumped with the other hand to dispense foam. For such applications, conically-shaped member 88 may be interlocked with cup-shaped member 40 by means of a boss and groove arrangement whereby a boss projects out from the side of cylindrical section 90 into a groove located on the interior surface of cup member 40. The groove would have two turns in it so that member 88 could not be pulled out of member 40 without rotation.

Therefore, while the present invention has been described and illustrated with respect to the preferred and alternative embodiments, it will be appreciated that numerous variations of these embodiments may be made without departing from the scope of the invention disclosed herein.

Therefore what is claimed is:

1. A device for producing and dispensing foam, comprising:

a) a container having an interior; and b) pump means being attachable to said container, the pump means including an air chamber having an air inlet and air outlet, the pump means including a fluid chamber provided with a fluid outlet positioned with respect to the air outlet so that liquid exiting the fluid outlet communicates with the air outlet, the fluid chamber having a liquid inlet being in flow communication with the container interior and including a liquid inlet valve, the liquid inlet valve being movable between an open position to allow liquid from the container to enter the fluid chamber and a closed position, a liquid outlet valve located in the fluid chamber spaced from the liquid inlet valve, the liquid outlet valve being biased in the closed position, said pump means including a porous member for generating turbulence in fluid passing therethrough positioned to receive air and fluid from said air and fluid chamber outlets, said pump means including means for pressurizing the air chamber and the fluid chamber whereby when the fluid chamber is sufficiently pressurized the liquid inlet valve closes and the liquid outlet valve opens thereby forcing liquid through the fluid chamber outlet to commingle with air being simultaneously expelled through the air chamber outlet to form a liquid-air mixture which is forced through said porous member.

2. The device according to claim 1 wherein said pump means comprises first and second members cooperating to define the air and fluid chambers, wherein the first member is attachable to the container and is provided with the liquid inlet, the second member being movable with respect to the first member, whereby moving the second member towards the first member pressurizes the fluid and air chambers thereby expelling liquid and air from the respective chambers.

3. The device according to claim 2 wherein the first member is provided with a conduit defining a passageway extending from said fluid inlet, the second member having a proximal end portion and a piston extending from the proximal end portion and being receivable within said conduit, the piston having a passageway extending therethrough in flow communication with the passageway in the conduit, the passageways through the conduit and the piston cooperating to form said fluid chamber.

4. The device according to claim 3 wherein the inlet valve includes a valve stem attached to a valve seat, the valve stem being located in the fluid inlet and protruding into the interior of the container, the valve seat being located in the fluid chamber, and wherein moving the second member away from the first member reduces the pressure in the fluid chamber thereby drawing the inlet valve to the open position and pumping liquid from the container into the fluid chamber, and wherein moving the second member towards the first member pressurizes the fluid chamber thereby forcing inlet valve towards the container interior so that the valve seat seals the fluid inlet.

5. The device according to claim 3 wherein said second member is movable with respect to said first member in telescoping relation.

6. The device according to claim 5 wherein said outlet valve includes a spring for urging the outlet valve closed, and wherein the outlet valve opens when the fluid chamber has been pressurized a predetermined amount.

7. The device according to claim 1 wherein said container is a collapsible container, wherein the container collapses as liquid is drained therefrom.

8. The device according to claim 5 wherein the air inlet is the air outlet.

9. The device according to claim 1 wherein said porous member is a mesh.

10. The device according to claim 5 wherein the dispenser includes a housing, the container with attached pump means being releasably insertable into said housing, including a lever attached to the housing and movable with respect thereto, the second member of the pump means being operably coupled to the lever so that moving the lever moves the second member with respect to the first member.

11. The device according to claim 10 wherein the housing includes bias means for urging the second member away from the first member.

12. A dispenser for producing and dispensing foam, comprising:

a) a container having an interior;

b) pump means being attachable to said container, the pump means including an air chamber having an air inlet and air outlet, the pump means including a fluid chamber provided with a fluid outlet positioned with respect to the air outlet so that liquid exiting the fluid outlet communicates with the air outlet, the fluid chamber having a liquid inlet being in flow communication with the container interior and including a liquid inlet valve, the liquid inlet valve being movable between an open position to allow liquid from the container to enter the fluid chamber and a closed position, a liquid outlet valve located in the fluid chamber spaced from the liquid inlet valve, the liquid outlet valve being biased in the closed position, said pump means including a porous member for generating turbulence in fluid passing therethrough positioned to receive air and fluid from said air and fluid chamber outlets, said pump means including means for pressurizing the air chamber and the fluid chamber whereby when the fluid chamber is sufficiently pressurized the liquid inlet valve closes and the liquid outlet valve opens thereby forcing liquid through the fluid chamber outlet to commingle with air being simultaneously expelled through the air chamber outlet to form a liquid-air mixture which is forced through said porous member; and c) a housing, the container with attached pump means being releasably insertable into said housing, including a lever attached to the housing and movable with respect thereto, the pump means being operably coupled to the lever so that moving the lever pressurizes the air and fluid chambers simultaneously.

13. The dispenser according to claim 12 wherein said lever is a pushbutton pivotally attached to the housing, said pump means including first and second members cooperating to define the air and fluid chambers, said housing including biasing means for biasing the second member away from the first member, whereby depressing the pushbutton causes the second member to move towards the first member to pressurize the fluid and air chambers, and upon release of the pushbutton said biasing means urges said second member away from the first member.

14. The dispenser according to claim 13 wherein the first member is provided with a conduit defining a passageway extending from said fluid inlet, the second member having a proximal end portion and a piston extending from the proximal end portion and being receivable within said conduit, the piston having a passageway extending therethrough in flow communication with the passageway in the conduit, the passageways through the conduit and the piston cooperating to form said fluid chamber.

15. The dispenser according to claim 14 wherein the outlet valve includes a valve stem attached to a valve seat, the valve stem being located in the fluid inlet and protruding into the interior of the container, the valve seat being located in the fluid chamber, and wherein moving the second member away from the first member reduces the pressure in the fluid chamber thereby drawing the inlet valve to the open position and pumping liquid from the container into the fluid chamber, and wherein moving the second member towards the first member pressurizes the fluid chamber thereby forcing inlet valve towards the container interior so that the valve seat seals the fluid inlet.

16. The dispenser according to claim 14 wherein the air inlet is the air outlet.

17. The dispenser according to claim 12 wherein said container is a collapsible container, wherein the container collapses as liquid is drained therefrom.

18. The dispenser according to claim 12 wherein said porous member is a mesh.

* * * * *